US006418687B1

(12) United States Patent
Cox

(10) Patent No.: US 6,418,687 B1
(45) Date of Patent: Jul. 16, 2002

(54) INSULATED ROOFING SYSTEM

(76) Inventor: Stanley Alfred Cox, 115 Fairway Dr., Callander, Ontario (CA), P0H 1H0

( * ) Notice: Subject to any disclaimer, the term of this patent is extended or adjusted under 35 U.S.C. 154(b) by 0 days.

(21) Appl. No.: 09/634,989

(22) Filed: Aug. 8, 2000

(51) Int. Cl.[7] ..... E04B 7/00

(52) U.S. Cl. ..... 52/309.4; 52/309.8; 52/408; 52/745.06

(58) Field of Search ..... 52/309.4, 309.5, 52/309.8, 309.3, 411, 408, 746.11, 745.06, 749.12, 309.1; 156/71, 78, 182

(56) References Cited

U.S. PATENT DOCUMENTS

| | | | | | |
|---|---|---|---|---|---|
| 3,971,184 | A | * | 7/1976 | Van Wagoner | 52/613 |
| 4,045,934 | A | * | 9/1977 | Sheahan et al. | 52/514 |
| 4,235,058 | A | * | 11/1980 | Patry | 52/408 |
| 4,368,604 | A | * | 1/1983 | Spielau et al. | 52/309.8 |
| 4,450,192 | A | * | 5/1984 | Cogliano | 428/40 |
| 4,450,663 | A | * | 5/1984 | Watkins | 52/309.4 |
| 5,119,611 | A | * | 6/1992 | Goertz | 52/309.4 |
| 5,494,228 | A | * | 2/1996 | Eaton et al. | 239/754 |
| 5,557,896 | A | * | 9/1996 | Imeokparia et al. | 52/408 |
| 6,108,993 | A | * | 8/2000 | Hageman | 52/408 |
| 6,305,143 | B1 | * | 10/2001 | Streets et al. | 52/46.11 |

* cited by examiner

*Primary Examiner*—Carl D. Friedman
*Assistant Examiner*—Jennifer I. Thissell

(57) ABSTRACT

The present invention relates to an insulated roofing system comprising a closed cell foamed in place insulation applied over the roof deck or existing substrate. In the preferred embodiment the foamed in place insulation is selected from foamed synthetic resins made of polystyrene, polyethylene, acrylic resin, phenol resin, urea resin, epoxy resin, diallylphthalate resin, urethane resin and the like. The preferred foamed in place insulation is a urethane foam. A rubber membrane is fully adhered over the insulation by an adhesive. The rubber membrane is selected from natural or synthetic rubbers such as styrene-butadiene rubber, acrylonitrile-butadiene rubber, chloroprene rubber, butadiene rubber, isoprene rubber, butyl rubber, ethylene-propylene rubber, ethylene-propylene diene mar (E.P.D.M.), polyisobutylene, styrene-butadiene-styrene block copolymer, styrene-isoprene-styrene block copolymer, chlorinated polyethylene, ethylene-vinyl acetate copolymer and the like either alone or in combination. The rubber membrane is preferably 45–60 mil thick E.P.D.M. The adhesive preferably consists of a slower curing adhesive that will permit the rubber membrane to be placed over the insulation and adjustments made to smooth it out before the adhesive cures. In the preferred embodiment a urethane foam adhesive with a cure time of about 20 minutes is sprayed over the foamed in place insulation.

10 Claims, 1 Drawing Sheet

INSULATED ROOFING SYSTEM

BACKGROUND OF THE INVENTION

1. Field of the Invention

This invention relates to roofing systems, in particular insulated roofing systems.

2. Description of the Prior Art

Various roofing systems are known both for flat and sloped roofs to insulate and waterproof the roof. On flat roofs the most common roofing system for waterproofing is a built up laminar structure comprising a plurality of felt layers with each layer or series of layers over-laid with a hot bituminous (tar) composition to bind the felt to the roof. A layer of gravel tops off the structure. However elevated roof temperatures will cause cracking, vapor blisters, splitting or ridging. In addition the gravel has a tendency to sink into tie bituminous material during hot summer months. All of these factors result in standing water eventually seeping though the tar and gravel coating requiring a new roof to be installed. In recent years, as the advantages of applying insulation on the exterior as opposed to the interior of the roof deck have become known, the built up roof structure has been applied over insulation materials, typically sheets of insulation material. This created new problems as the insulating materials had poor mechanical properties had seams where water could seep through, needed to be fastened to the roof deck, are subject to degradation by UV radiation and absorbed moisture. In addition the built up roof systems are very labour intensive making them less economical. Numerous attempts have been made unsuccessfully to solve one or more of these problems. For example see U.S. Pat. No. 4,016,323; 4,021,981; 4,087,296; 4,212,913; 4,374,687: 4,668,315 and 4,837,095.

A common insulted roofing system in use today is that shown in U.S. Pat. No. 5,251,416. This system utilizes a series of foam insulation board panels with a thin rubber membrane bonded to the top surface of each board to render the insulation waterproof. The panels are mechanically fastened to the roof substrate. Rubber strips are applied with adhesive to overlap Joints between panels and the fasteners adjacent the joints. This system has a number of drawbacks. First if the rubber membrane is pierced the insulation board soaks up water and eventually the roof will leak. Secondly the joints between panels break down as the urethane foam commonly used absorbs moisture. Life expectancy of the roof is 4 to 5 years. The roof is entirely dependent on the thin membrane, which is approximately 10% of cost of roof to provide waterproofing.

For roofs with positive drainage, a sprayed on insulation foam has been utilized. A waterproof coating is then sprayed on top of the foam. This eliminates the problems experienced with mechanical fastening of panels however the system has not proven practical with relatively flat roofs. Any standing water will break down the coating and ultimately the foam. In addition the sprayed insulation foam cannot be applied over a conventional built up tar and gravel roof so the tar and gravel substrate needs to be removed before applying the new roof. This eliminates any cost savings over the use of mechanically fastened panels. In addition while the sprayed in place foam insulation is 90% closed cell (as opposed to open cell foam panels) and therefore provides some waterproofing, standing water and UV radiation will break it down. In addition the sprayed in place foam and coating systems do not stand up in cold climates. Installing sprayed in place urethane roofing foam over steel roofing with positive drainage has worked well.

However sprayed in place urethane foam applied over flat roofs to manufacturers specifications after two or three years starts developing cracks due to cold climate and effects of standing water. While numerous coatings have been proposed none has provided an efficient and reliable waterproof and U.V. protection for the foam. Foamed in place urethane roofing due to the unavailability of an effective coating has not be approved or specified by engineers.

SUMMARY OF THE INVENTIOn

It is an object of the invention to provide an energy efficient, economical and dependable insulated roofing system.

It is a further object of the invention to provide an insulated roofing system that can be installed over existing tar and gravel substrate without removing the existing roofing.

Thus in accordance with the present invention there is provided an insulated roofing system comprising a closed cell, foamed in place insulation applied over the roof deck or existing substrate. In the preferred embodiment the foamed in place insulation is selected from foamed synthetic resins made of polystyrene, polyethylene, acrylic resin, phenol resin, urea resin, epoxy resin, diallylphthalate resin, urethane resin and the like. The preferred foamed in place insulation is polyurethane foam. A rubber membrane is fully adhered over the insulation by an adhesive. The rubber membrane is selected from natural or synthetic rubbers such as styrene-butadiene rubber, acrylonitrile-butadiene rubber, chloroprene rubber, butadiene rubber, isoprene rubber, butyl rubber, ethylene-propylene rubber, ethylene-propylene diene mar (E.P.D.M.), polyisobutylene, styrene-butadiene-styrene block copolymer, styrene-isoprene-styrene block copolymer, chlorinated polyethylene, ethylene-vinyl acetate copolymer and the like either alone or in combination. The rubber membrane is preferably 45–60 mil thick E.P.D.M. The adhesive preferably consists of a slower curing adhesive that will permit the rubber membrane to be placed over the insulation and adjustments made to smooth it out before the adhesive cures. In the preferred embodiment a urethane foam adhesive with a cure time of about 20 minutes is sprayed over the foamed in place insulation.

In another embodiment the present invention comprises a method to apply an insulated roofing system comprising the following steps : (a) first clean the roof substrate (b) then foaming in place a closed cell roofing foam insulation (c) next applying a slow acting adhesive to the surface of the foamed in place insulation (d) then rolling a rubber membrane over the adhesive and (e) then smoothing out or adjusting the membrane to fully cover and be adhered to the foam insulation.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, With reference to the accompanying drawings, in which.

DETAILED DESCRIPTION OF THE PREFERRED EMBODIMENT

Figure 1:
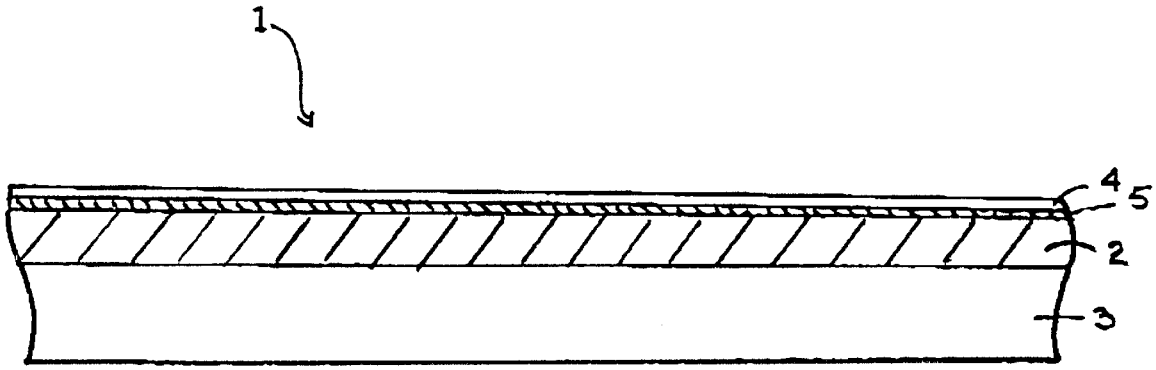
FIG. 1 is a cross-sectional view of an insulated roofing system according to the press invention.

Referring to FIG. 1, an insulated roofing system according to the present invention is generally indicated at 1. The roofing system 1 of the present invention comprises a closed cell, foamed in place insulation 2 applied over the roof deck or existing substrate 3. In the preferred embodiment the foamed in place insulation is selected from foamed synthetic resins made of polystyrene, polyethylene, acrylic resin, phenol resin, urea resin, epoxy resin, diallylphthalate resin, urethane resin and the like. The preferred foamed in place insulation is polyurethane foam about 1.5 to 2 inches thick in order to provide required insulation properties. The foamed in place insulation should be selected to have sufficient adherence to the roof deck or substrate to resist wind uplift pressure and remain anchored to the roof deck. Utilizing a closed cell foam insulation as opposed to an open cell foam provides waterproofing by the insulation foam. A rubber membrane 4 is applied over the insulation 2. The rubber membrane is selected from natural or synthetic rubbers such as styrene-butadiene rubber, acrylonitrile-butadiene rubber, chloroprene rubber, butadiene rubber. isoprene rubber, butyl rubber, ethylene-propylene rubber, ethylene-propylene diene mar (E.P.D.M.), polyisobutylene, styrene-butadiene-styrene block copolymer, styrene-isoprene-styrene block copolymer, chlorinated polyethylene, ethylene-vinyl acetate copolymer and the like either alone or in combination. The rubber membrane is preferably 45–60 mil thick E.P.D.M. obtainable from numerous manufacturers including Firestone. The E.P.D.M. rubber membrane is obtainable in 20×100 foot rolls . As alternative a felt backed E.P.D.M rubber membrane can be used however the felt backed product is considerably more expensive. Although the E.D.PM. material is not recommended by tie supplier for installation over sprayed in place urethane insulation, the present invention has determined there are no adverse reactions between the two materials and numerous hitherto unsuspected advantages are achieved when applied in accordance with the present invention using the adhesive as described below.

The rubber membrane 4 is fully adhered to the foamed in place insulation 2 by an adhesive 5. Fully adhereing the membrane is recommended to make sure the membrane will resist wind uplift pressures that can damage the roof or even blow it off. In addition fully adhereing the membrane will decrease the risk of the membrane splitting due to temperature changes or ice and snow or standing water. The adhesive 5 preferably consists of a slower curing adhesive that will permit the rubber membrane 4 to be placed over the insulation 2 and adjustments made to smooth it out before the adhesive cures. In the preferred embodiment a urethane foam adhesive with a cure time of about 20 minutes is sprayed about ¼ inch thick over the foamed in place insulation 2. The adhesive should fill in any indentations in the insulation and permit the rubber membrane to be fully adhered to the insulation. The E.P.D.M. rubber membrane is then rolled into place and fully adhered to the insulation. Bonding adhesives recommended by E.P.D.M. manufacturers are typically contact cements and must de applied to both the roof and the E.P.D.M. The labour involved to fully adhere the membrane makes it cost prohibitive. Even where the adhesive is applied in a grid pattern, the time and effort reduces the cost effectiveness.

The roofing system of the present invention replaces and improves upon other systems utilizing 4×8 ft. panels of open cell urethane insulation coated with E.P.D.M., or other coating membranes, mechanically fastened to roof substrates. When these conventional systems are compromised, i.e. E.P.D.M. or other membrane is pierced or a joint loosens etc., water infiltrates roof, soaks into the insulation and enters building. With the roofing system of the present invention, failure of the membrane does not compromise the system, as the foamed in place closed cell urethane roofing foam is monolithic and waterproof. Additional advantages of the present invention over the panelized systems of the prior art include less labour to install, no joints to fill in, elimination of metal fasteners that can corrode causing failure of the fastening of the panels to the roof or puncturing the membrane or otherwise creating leaks.

To apply a roofing system in accordance with the present invention, first clean the roof substrate by power sweeping or power washing to facilitate adhesion of foam insulation. Then foam in place 1.5 to 2 inches polyurethane roofing foam insulation. Next, after the insulation layer has cured sufficiently to walk on and off gas before covering, usually about 45 minutes, spray a slow acting urethane adhesive to the surface of the foamed in place polyurethane foam insulation. Then roll the E.P.D.M. membrane over the adhesive. Because of slow acting nature of the adhesive the E.P.D.M. may be smoothed out or adjusted to fully cover and be adhered to the foam insulation. Because the E.P.D.M. membrane comes in 20×100 foot rolls, in the preferred embodiment the roofing system of the pcsent invention can be applied in sections. The foamed in place insulation is applied to an up to 24×100 foot area. Then the adhesive is applied and E.P.D.M. membrane installed in place. The adhesive as noted above is preferably a sprayed in place urethane foam adhesive. One such adhesive can be obtained from Gaco Western. At the recommend temperatures this product is too quick acting. By applying the adhesive at a lower temperature, it reacts slower and permits sufficient time to roll the membrane in place, smooth it out and provide a consistent overlap with adjoining sections. Then the foamed in place insulation is sprayed on to an adjoining up to 24×100 foot area of the roof making a consistent joint with the previously applied insulation. When the E.P.D.M. membrane is applied over this second area, the membrane is applied so it overlaps the adjoining section of membrane by preferrably at least 3 inches inches and then seamed with seam tape (rubber strips) and solvent adhesive, to get a consistent joint and waterproof roof. The roof deck or substrate should be dry before the insulation foam is applied. Similarily the insulation foam should be dry before application of the adhesive foam By applying the roofing system of the present invention in sections, delays as a result of overnight changes in weather are minimized as they malt require any overnight rainfall on the roof deck or substrate or on top of the insulation foam to be removed before continuing.

The system of the present invention provides an economical insulated roofing system that is relatively light weight, energy efficient and waterproof roof that will last for at least ten years. The system of the present invention is two roofing Systems in one. The roofing foam insulation is waterproof and is monolithic so there are no seams. The rubber membrane is adhered over the insulation making a second waterproof seal over the complete roof. The existing roof in most cases does not have to be completely removed resulting in savings in time, money and landfill use.

Having illustrated and described a preferred embodiment of the invention and certain possible modifications thereto, it should be apparent to those of ordinary skill in the art that the invention permits of further modification in arrangement and detail. All such modifications are covered by the scope of the invention.

The embodiments of the invention in which an exclusive property or privilege is claimed are defined as follows:

1. An insulated roofing system for application to a roof deck or an existing roof substrate comprising a monolithic and waterproof insulation layer, said insulation layer being a closed cell, foamed in place insulation applied over the roof deck or existing roof substrate, a rubber membrane fully adhered over the insulation by an adhesive with a cure time to permit the rubber membrane to be placed over the insulation and adjustments made to smooth the rubber membrane before the adhesive cures.

2. An insulated roofing system according to claim 1 wherein said foamed in place insulation is selected from the group consisting of foamed synthetic resins made of polystyrene, polyethylene, acrylic resin, phenol resin, urea resin, epoxy resin, diallylphthalate resin and urethane resin.

3. An insulated roofing system according to claim 2 wherein said foamed in place insulation is a polyurethane foam.

4. An insulated roofing system according to claims 1, 2 or 3 wherein the rubber membrane is made from one or more natural or synthetic rubbers selected from the group consisting of styrene-butadiene rubber, acrylonitrile-butadiene rubber, chloroprene rubber, butadiene rubber, isoprene rubber, butyl rubber, ethylene-propylene rubber, ethylene-propylene diene mar (E.P.D.M.), polyisobutylene, styrene-butadiene-styrene block copolymer, styrene-isoprene-styrene block copolymer, chlorinated polyethylene and ethylene-vinyl acetate copolymer.

5. An insulated roofing system according to claim 4 wherein the said rubber membrane is 45–60 mil thick E.P.D.M.

6. An insulated roofing system according to claim 5 wherein said adhesive is a urethane foam adhesive with a cure time of about 20 minutes sprayed over the foamed in place insulation.

7. A method to apply an insulated roofing system over a roof deck or existing roof substrate according to claim 1 comprising the following steps: (a) first clean the roof substrate (b) then foaming in place a monolithic and waterproof insulation layer, said insulation layer being a closed cell roofing foam insulation (c) after the insulation layer has cured sufficiently to walk on, applying an adhesive to the surface of the foamed in place insulation (d) then rolling a rubber membrane over the adhesive and (e) smoothing or adjusting the rubber membrane to fully cover and be fully adhered to the foam insulation.

8. A method according to claim 7 wherein said closed cell roofing foam is a urethane foam 1.5 to 2 inches thick.

9. A method according to claim 7 or 8 wherein the foamed in place insulation is applied in up to 24×100 foot sections, then a urethane foam adhesive sprayed on to said insulation and a 20×100 foot roll of rubber membrane rolled over the adhesive.

10. A method according to claim 9 wherein the rubber membrane overlaps the rubber membrane on adjoining sections and is seamed and sealed with seam tape and a solvent adhesive.

* * * * *